US011933292B2

(12) United States Patent
Bruin

(10) Patent No.: US 11,933,292 B2
(45) Date of Patent: Mar. 19, 2024

(54) DEVICE FOR CONTROLLING THE LOAD OF A MOBILE FLUID PUMP

(71) Applicant: B.B.A. PARTICIPATIES B.V., Klarenbeek (NL)

(72) Inventor: Johannes Bruin, Klarenbeek (NL)

(73) Assignee: B.B.A. PARTICIPATIES B.V., Klarenbeek (NL)

( * ) Notice: Subject to any disclaimer, the term of this patent is extended or adjusted under 35 U.S.C. 154(b) by 222 days.

(21) Appl. No.: 17/294,770

(22) PCT Filed: Nov. 11, 2019

(86) PCT No.: PCT/NL2019/050734
§ 371 (c)(1),
(2) Date: May 18, 2021

(87) PCT Pub. No.: WO2020/106137
PCT Pub. Date: May 28, 2020

(65) Prior Publication Data

US 2022/0010787 A1 Jan. 13, 2022

(30) Foreign Application Priority Data

Nov. 24, 2018 (NL) ..... 2022071

(51) Int. Cl.
*F04B 49/22* (2006.01)
*F04B 17/06* (2006.01)
*F04B 53/16* (2006.01)

(52) U.S. Cl.
CPC ..... *F04B 49/22* (2013.01); *F04B 17/06* (2013.01); *F04B 53/16* (2013.01); *F04B 2205/06* (2013.01)

(58) Field of Classification Search
CPC ..... F04B 17/06; F04B 49/22; F04B 53/16; F04B 2205/06
See application file for complete search history.

(56) References Cited

U.S. PATENT DOCUMENTS 4,243,892 A 1/1981 Andersson et al.
6,116,138 A * 9/2000 Achten ..... F04B 1/2042 91/472

(Continued)

FOREIGN PATENT DOCUMENTS

CN 204342586 U * 5/2015
EP 3839268 A1 * 6/2021 ..... E02F 9/2217

(Continued)

OTHER PUBLICATIONS

English Machine Translation of CN-204342586-U (Year: 2015).*

(Continued)

*Primary Examiner* — Nathan C Zollinger
(74) *Attorney, Agent, or Firm* — Workman Nydegger

(57) ABSTRACT

A device is provided for controlling the load of a mobile fluid pump which at an exit side is coupled to an outlet conduit, including an assembly that is a mobile unit and that includes an inlet conduit that can be coupled to the outlet conduit, which inlet conduit branches into a first conduit part and a second conduit part. A controllable closing valve is accommodated in the first conduit part and a turbine is accommodated in the second conduit part. A pressure sensor is accommodated in the inlet conduit, the first conduit part or the second conduit part, further including a generator that is drivable by the turbine and a measurement and control circuit that can be coupled to the pressure sensor and the controllable closing valve.

18 Claims, 3 Drawing Sheets

(56) References Cited

U.S. PATENT DOCUMENTS

| | | | | |
|---|---|---|---|---|
| 6,394,206 | B1 * | 5/2002 | Fury | H02P 9/04 180/53.4 |
| 7,053,498 | B1 * | 5/2006 | Boisvert | F15B 21/08 290/40 C |
| 8,181,458 | B2 * | 5/2012 | Roeber | F04C 11/003 60/489 |
| 2009/0084104 | A1 | 4/2009 | Roeber | |
| 2014/0093403 | A1 | 4/2014 | Jones et al. | |
| 2016/0167806 | A1 | 6/2016 | Rice et al. | |

FOREIGN PATENT DOCUMENTS

| | | | | |
|---|---|---|---|---|
| FR | 1099107 | A | 8/1955 | |
| WO | WO-2020174295 | A1 * | 9/2020 | F03B 1/00 |

OTHER PUBLICATIONS

International Search Report and Written Opinion from PCT Application No. PCT/NL2019/050734, dated Feb. 4, 2020.
Netherlands Search Report from corresponding NL Application No. NL2022071, dated Jul. 8, 2019.

* cited by examiner

DEVICE FOR CONTROLLING THE LOAD OF A MOBILE FLUID PUMP

BACKGROUND

The invention relates to a device for controlling the load of a mobile fluid pump.

Here "mobile fluid pump" is understood to mean a fluid pump that is configured for in combination with a driving motor for said pump, to be temporarily used at various locations, for various pumping tasks. Mobile fluid pumps are for instance used in pumping up groundwater at locations where a connection to the public water mains is not available, at building sites for keeping the building site in question dry, or for water drainage in case of calamities such as floods.

The wide usability of a mobile fluid pump involves the pump being subjected to highly diverse requirements in terms of the fluid flow rate to be delivered, the conveying height of a fluid to be pumped, the distance over which a liquid has to be pumped and the amount of mechanical pollutions such as sand, gravel, branches and leaves that have fallen off, in the fluid to be pumped.

In practical situations, there is a tendency to use a mobile fluid pump of an as high as possible capacity in order to comply with the highly diverse requirements. Using a pump of too high a capacity for the operational conditions aimed at, involves the risk of cavitation occurring in the pump, for instance as a result of the fact that the fluid pressure at the exit side of the pump is too low. To avoid the occurrence of cavitation, use is for instance made of a closing valve in the pump conduit at the exit side, with which the conduit is partially closed off, as a result of which the static pressure of the fluid is increased. An inherent disadvantage of increasing the fluid pressure is that this measure costs extra energy, which is released in the pumped liquid as unusable residual energy in the form of heat and turbulent flows.

SUMMARY

It is an object of the invention to provide a device for controlling the load of a mobile fluid pump, by means of which the occurrence of cavitation in the fluid pump is prevented without this requiring extra energy that fully dissipates and is discharged in the form of heat and turbulent flows. Such a device needs to be robust and resistant to a multitude of mechanical pollutions such as sand, gravel, branches and leaves that have fallen off, in the fluid to be pumped.

These objects are achieved, and other advantages are realized, using a device for controlling the load of a fluid pump that is accommodated in a combination with a driving motor for said fluid pump, wherein at an exit side the fluid pump is coupled to an outlet conduit, which according to the invention is provided by an assembly that is a mobile unit and that comprises a conduit system, comprising an inlet conduit that can be coupled to the outlet conduit, which inlet conduit branches into a first conduit part and a second conduit part, wherein a controllable closing valve is accommodated in the first conduit part and a turbine is accommodated in the second conduit part, and wherein a pressure sensor is accommodated in one of the outlet conduit, the inlet conduit, the first conduit part and the second conduit part, a generator that is drivable by the turbine, and a measurement and control circuit that can be coupled to the pressure sensor and the controllable closing valve for consecutively setting a target value of the fluid pressure in the outlet conduit and in a coupled condition of the outlet conduit and the conduit system in dependence on the value of the fluid pressure as measured by the pressure sensor, controlling the controllable closing valve such that the measured value of the fluid pressure corresponds to the target value.

In such a device for instance a fluid pump that is known per se can be chosen as turbine, wherein the flow direction between inlet side and outlet side is reversed. In that way the specifications of the turbine in terms of the capacity of, and the nature and quantity of pollutions in the fluid to be pumped can easily be made compatible to those of the fluid pump in the mobile combination. The electricity generated by the generator driven by the turbine may, depending on the local conditions where the device is used, be stored in situ in a mobile battery package or be supplied to a local network. The controllable closing valve is for instance a slide valve or throttling plate known per se. Circuits that are known per se can be used in the measurement and control circuit, for instance to synchronize the generated current at a frequency of 50 or 60 Hz.

The pressure sensor can be accommodated in the outlet conduit of the mobile pump unit.

In a practically advantageous embodiment the pressure sensor is accommodated in the conduit system of the device itself, for instance in the inlet conduit, the first conduit part or the second conduit part.

In a robust embodiment the conduit system and the generator are provided on a frame.

In this latter embodiment, the measurement and control circuit is preferably also provided on the frame.

For easily moving the frame and the parts present thereon, in another embodiment the frame is provided with a pair of parallel tube profiles at its bottom side. These tube profiles preferably are placed such that the respective teeth of the fork of a forklift truck can be accommodated in them.

In another embodiment, the device is provided with a housing for accommodating at least the conduit system and the generator therein, which housing preferably is configured for accommodating the measurement and control circuit therein as well.

BRIEF DESCRIPTION OF THE DRAWINGS

The invention will be elucidated below on the basis of exemplary embodiments, while referring to the drawings.

In the Drawings

In the figures, similar parts are referred to by the same reference numbers.

DETAILED DESCRIPTION OF VARIOUS EMBODIMENTS

Figure 1:
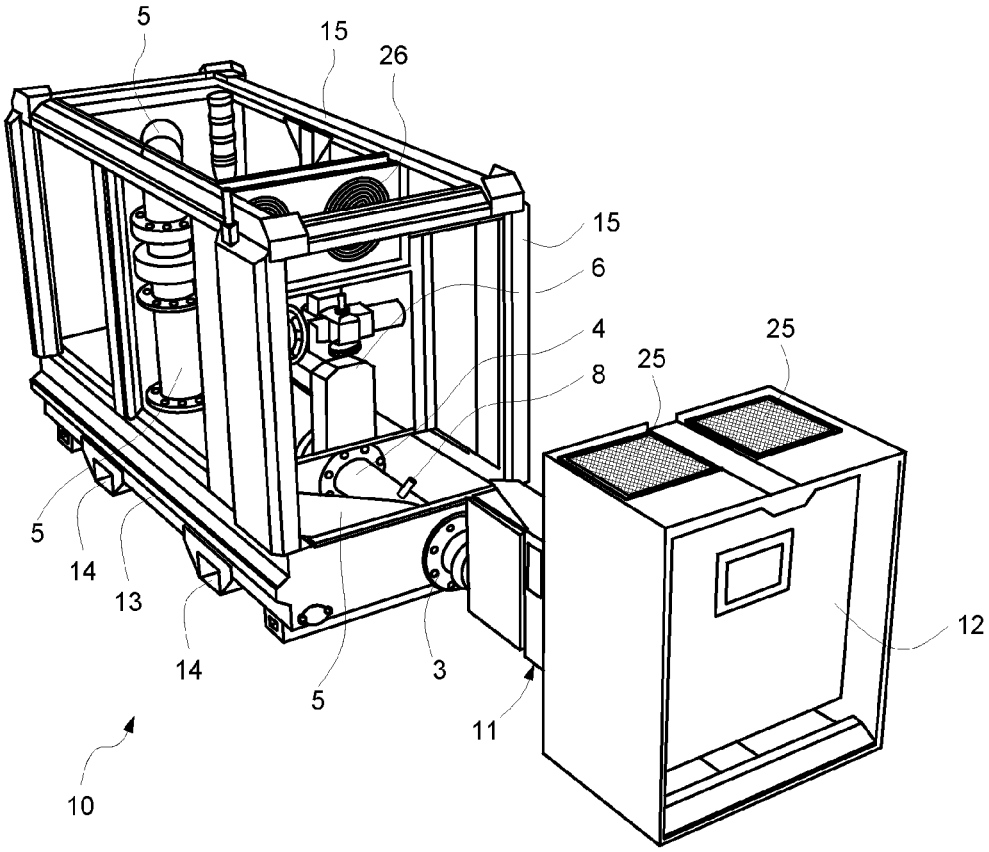
FIG. 1 shows an exploded view of a first embodiment of a mobile pump load in housing according to the invention, viewed under a first angle.

FIG. 1 shows a mobile device 10 for controlling the load of a mobile fluid pump (not shown), having an inlet conduit 3 which branches into a first conduit part 4 and a second conduit part 5. A pressure sensor 8 and a controllable closing valve 6 are accommodated in the first conduit part, a turbine 7 (shown in FIG. 2) driving a generator 9 (shown in FIG. 2) is accommodated in the second conduit part 5. The unit is borne by a frame 13, which at its bottom side is provided with a pair of parallel tube profiles 14 for accommodating the respective teeth of the fork of a forklift truck in them. Also placed on the frame 13 is a casing 11 including the measurement and control circuit for controlling the load using fans 26 and fan grills 25. A door 12 gives access to a control panel for the measurement and control circuit (not shown). The frame 13 further bears a housing 15 for the above-mentioned parts placed on the frame.

Figure 2:
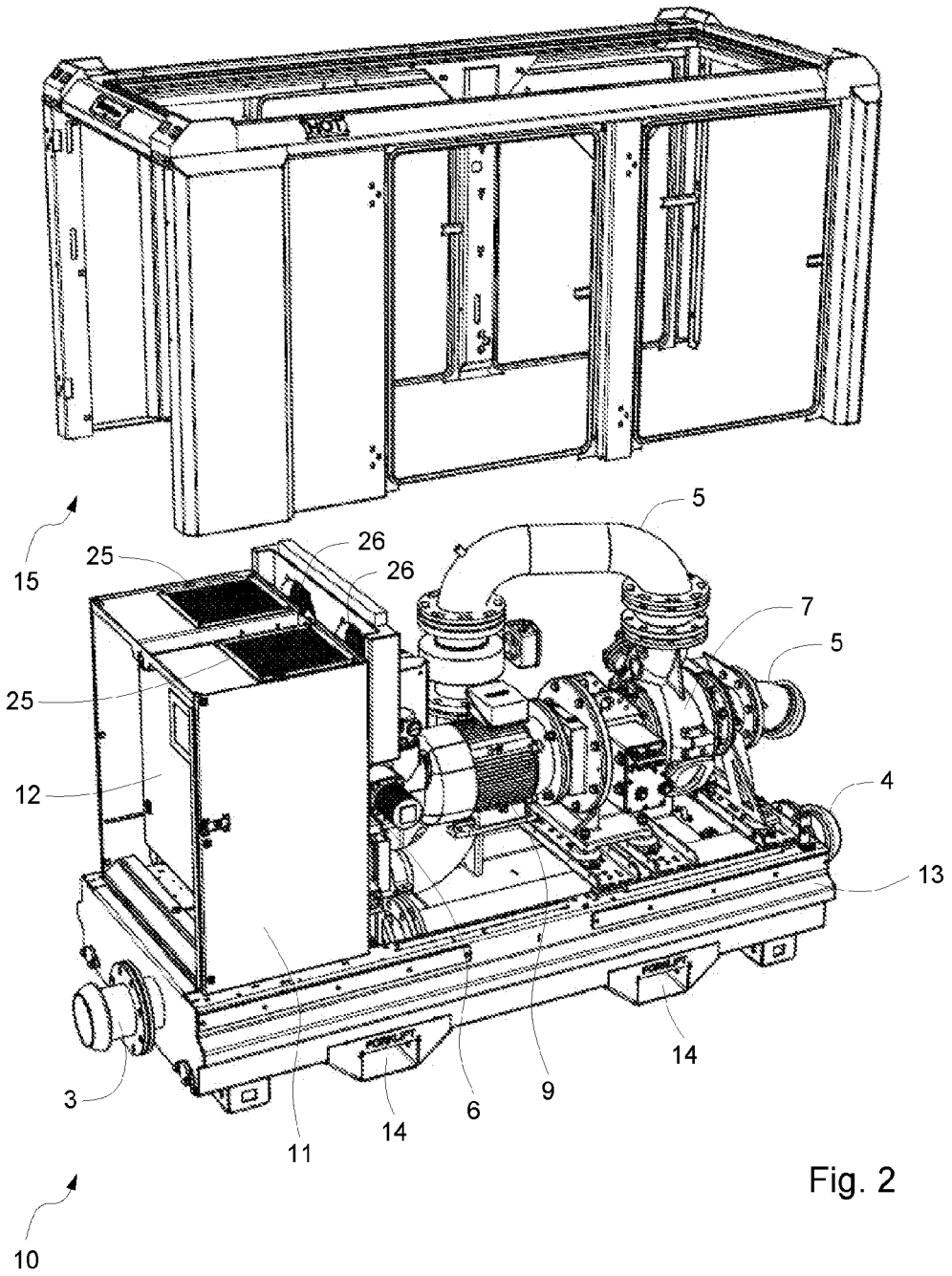
FIG. 2 shows an exploded view of the housing shown in FIG. 1 with the mobile pump load in assembled condition, viewed under a second angle.

FIG. 2 shows the device 10 in an assembled condition, viewed at a long side with the generator 9.

Figure 3:
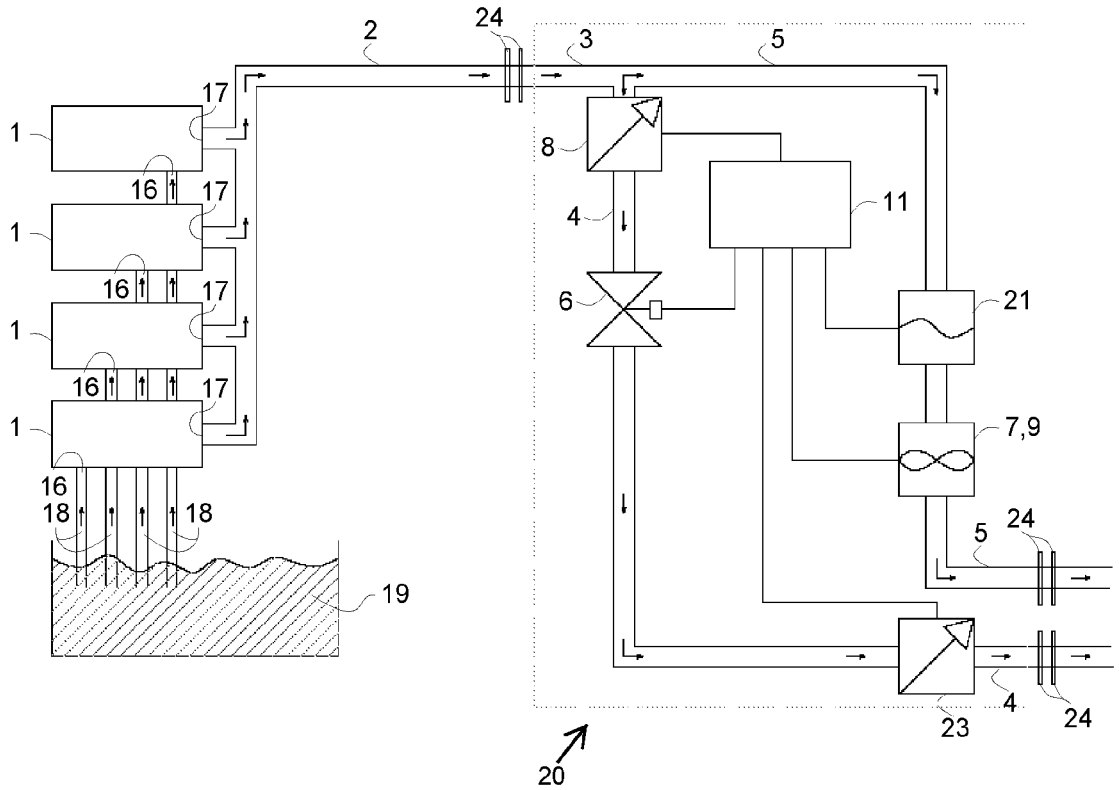
FIG. 3 shows a schematic view of four mobile fluid pumps positioned parallel in an operational condition and a pump load coupled to those pumps according to a second embodiment of the invention.

FIG. 3 is a simplified representation of four mobile fluid pump units 1 positioned parallel and a pump load 3 coupled to the respective pumps. In the situation shown, at their entry sides 16, the respective pumps debouch with an inlet pump conduit 18 into a basin 19, and at their exit sides 17 they are coupled to an outlet conduit 2 which by means of flanges 24 is coupled to the inlet conduit 3 of a device 20 for controlling the load of the pump units 1. The inlet conduit 3 of the device 20 branches into two parallel parts 4, 5: a first conduit part 4 in which a pressure sensor 8, a controllable slide valve 6 and a second pressure sensor 23 are accommodated, and a second conduit part 5 in which consecutively a flow meter 21 and a combination of a turbine 7 and a generator 9 driven by it are accommodated. The first pressure sensor 8, the second pressure sensor 23, the flow meter 21, the combination 7, 9 of turbine and generator and the controllable slide valve 6 are all electronically coupled to a measurement and control circuit 11, 12. The arrows in the conduits 18, 2, 3, 4, 5 indicate the flow direction of the fluid.

The measurement and control circuit 11, 12 is configured for measuring the value of the fluid pressure in the outlet conduit 2 using the first pressure sensor 8. The measurement and control circuit 11, 12 is configured for setting the target value of the fluid pressure in the outlet conduit 2. The measurement and control circuit 11, 12 is configured for controlling the controllable valve 6 such that the measured value of the liquid pressure in the outlet conduit 2 corresponds to the target value. The electricity generated by the generator driven by the turbine may, depending on the local conditions where the device is used, be stored in situ in a mobile battery package or be supplied to a local network.

The invention claimed is:

1. A device for controlling a load of a fluid pump that is accommodated in a combination having a driving motor for said fluid pump, wherein at an exit side the fluid pump is coupled to an outlet conduit, wherein the device is provided by an assembly that is a mobile unit and that comprises:

a conduit system, comprising an inlet conduit that can be coupled to the outlet conduit, which inlet conduit branches into a first conduit part and a second conduit part, wherein a controllable closing valve is accommodated in the first conduit part and a turbine is accommodated in the second conduit part, and wherein a pressure sensor is accommodated in one of the outlet conduit, the inlet conduit, the first conduit part and the second conduit part, a generator that is drivable by the turbine, and a measurement and control circuit that can be coupled to the pressure sensor and the controllable closing valve for consecutively, setting a target value of the fluid pressure in the outlet conduit and in a coupled condition of the outlet conduit and the conduit system in dependence on the value of the fluid pressure as measured by the pressure sensor, controlling the controllable closing valve such that the measured value of the fluid pressure corresponds to the target value.

2. The device according to claim 1, wherein the pressure sensor is accommodated in one of the inlet conduit, the first conduit part and the second conduit part.

3. The device according to claim 1, wherein the conduit system and the generator are provided on a frame.

4. The device according to claim 3, wherein the measurement and control circuit is provided on the frame.

5. The device according to claim 3, wherein the frame is provided with a pair of parallel tube profiles at its bottom side.

6. The device according to claim 4, wherein the frame is provided with a pair of parallel tube profiles at its bottom side.

7. The device according to claim 1, wherein it is provided with a housing for accommodating at least the conduit system and the generator therein.

8. The device according to claim 7, wherein the housing is configured for accommodating the measurement and control circuit therein.

9. The device according to claim 1, wherein the pressure sensor is accommodated the inlet conduit.

10. The device according to claim 1, wherein the pressure sensor is accommodated in the first conduit part.

11. The device according to claim 1, wherein the pressure sensor is accommodated in the second conduit part.

12. The device according to claim 1, wherein the pressure sensor is configured to be accommodated in the outlet conduit.

13. The device according to claim 1, wherein the closing valve is a slide valve.

14. The device according to claim 1, wherein the closing valve is a throttling plate.

15. The device according to claim 1, wherein the generator is configured to be connected to a mobile battery package.

16. The device according to claim 1, wherein the generator is configured to be connected to a local electrical network.

17. A mobile pumping system comprising:

the device according to claim 1;

one or more fluid pumps, each of the one or more fluid pumps having an exit side coupled to an outlet conduit.

18. The mobile pumping system according to claim 17, wherein the one or more fluid pumps includes a plurality of fluid pumps.

* * * * *